US009170026B2

(12) United States Patent
Taplan et al.

(10) Patent No.: US 9,170,026 B2
(45) Date of Patent: Oct. 27, 2015

(54) HEATING ELEMENT

(71) Applicant: Schott AG, Mainz (DE)

(72) Inventors: Martin Taplan, Mainz (DE); Sascha Backes, Ruedesheim (DE)

(73) Assignee: Schott AG, Mainz (DE)

( * ) Notice: Subject to any disclaimer, the term of this patent is extended or adjusted under 35 U.S.C. 154(b) by 365 days.

(21) Appl. No.: 13/690,948

(22) Filed: Nov. 30, 2012

(65) Prior Publication Data

US 2013/0327760 A1 Dec. 12, 2013

(30) Foreign Application Priority Data

Dec. 1, 2011 (DE) ..... 10 2011 055 931

(51) Int. Cl.

| | |
|---|---|
| ***F24C 7/08*** | (2006.01) |
| ***F24C 7/06*** | (2006.01) |
| ***F24C 15/16*** | (2006.01) |
| ***F24C 15/18*** | (2006.01) |

(52) U.S. Cl.

CPC ..... *F24C 7/088* (2013.01); *F24C 7/062* (2013.01); *F24C 15/166* (2013.01); *F24C 15/18* (2013.01)

(58) Field of Classification Search

None

See application file for complete search history.

(56) References Cited

U.S. PATENT DOCUMENTS

| | | | | | |
|---|---|---|---|---|---|
| 2,994,760 | A * | 8/1961 | Pecoraro et al. | ..... | 219/394 |
| 4,780,597 | A * | 10/1988 | Linhart et al. | ..... | 219/404 |
| 5,618,458 | A * | 4/1997 | Thomas | ..... | 219/394 |
| 5,938,959 | A * | 8/1999 | Wang | ..... | 219/401 |
| 5,994,673 | A * | 11/1999 | El-Shoubary et al. | ..... | 219/403 |
| 6,545,251 | B2 * | 4/2003 | Allera et al. | ..... | 219/394 |
| 7,183,520 | B2 * | 2/2007 | Park | ..... | 219/394 |
| 7,297,905 | B2 * | 11/2007 | Kim et al. | ..... | 219/400 |
| 7,781,702 | B2 * | 8/2010 | Nam et al. | ..... | 219/391 |
| 8,803,045 | B2 * | 8/2014 | Cadima | ..... | 219/618 |
| 2007/0251936 | A1 * | 11/2007 | Nam et al. | ..... | 219/413 |
| 2009/0272728 | A1 * | 11/2009 | Abbott | ..... | 219/399 |
| 2012/0160228 | A1 * | 6/2012 | Kim et al. | ..... | 126/19 R |

FOREIGN PATENT DOCUMENTS

| | | | |
|---|---|---|---|
| DE | 3246445 | A1 * | 6/1984 |
| DE | 4217545 | A1 | 12/1993 |
| DE | 102009029460 | A1 | 3/2011 |
| DE | 102009054586 | A1 | 6/2011 |

* cited by examiner

*Primary Examiner* — Joseph M Pelham

(74) *Attorney, Agent, or Firm* — Ohlandt, Greeley, Ruggiero & Perle, LLP

(57) ABSTRACT

A heating element is provided that has at least one flat electrical heating device to heat at least one spatial region found on one side of the heating device. The heating device has a contact configured to connect to a power supply and control device of a baking and roasting oven. The contact is configured to alternately connect to an electronic mechanism external to the baking and roasting oven. In addition, an arrangement of the heating element with an electronic mechanism external to the baking and roasting oven is provided.

13 Claims, 10 Drawing Sheets

HEATING ELEMENT

The invention relates to a heating element having at least one flat electrical heating means for heating at least one spatial region found on one side of the heating means, the heating means having a contacting means for connecting to the power supply and control device of a baking and roasting oven, and the heating means forming a baking-space divider for inserting into the baking space of the baking and roasting oven and for dividing the baking space into two spatial regions.

An electrical baking and roasting oven with a baking space that can be closed by a door and that can be divided into two spatial regions separate from one another by a plate insertable horizontally into the baking space is known from DE 42 17 545 A1. The plate is provided with two flat electrical heating means that form a bottom heating unit for the upper spatial region and a top heating unit for the lower spatial region. This known heating element is difficult to clean, since contaminants can be deposited in the heating means during roasting, baking or cooking of foods. The known heating means is suitable only for use as a baking-space divider in the baking and roasting oven.

In addition, a heating element used as a baking-space divider that can be inserted into the baking space of an electrical baking and roasting oven is known from DE10 2009 029 460 A1. Heating elements with meandering heating filaments, each of which forms a thick-film element, are introduced on the top and the bottom of a temperature-resistant support plate made of glass ceramics. Each of the thick-film elements is provided with a layer of electrical insulation. The heating element is provided with a metal jacket and forms a bottom heating unit for the upper spatial region and a top heating unit for the lower spatial region. This known heating means is also suitable only for use as a baking-space divider in the baking and roasting oven.

Therefore, the object of the invention is to provide a heating element that, in addition to its use as a heatable baking-space divider, can also be used for multiple purposes outside the baking space.

The object of the invention is achieved by a heating element according to the features of patent claim 1 and by an arrangement of a heating element of this type with an electronic mechanism external to the baking and roasting oven according to the features of patent claim 11. Advantageous enhancements are described in each of the dependent claims.

In the heating element according to the invention, the contacting means is designed for alternative connection to an electronic mechanism external to the baking and roasting oven. It is possible in this way to operate the heating element not only inside the baking space of a baking and roasting oven as a baking-space divider, but rather, there is the possibility of creating fields of use even outside the baking space. For example, the heating element can be used as a warming plate for food, as a heating device for residential rooms, or as a terrace heater.

According to a basic concept of the invention, the heating means of the heating element can be covered on the side facing the spatial region to be heated with a plate comprising a selection of glass, glass ceramics and ceramics. In this way, the plate protects the heating means from contaminants and from damage. This glass, glass-ceramic or ceramic material thus offers an excellent heat conductivity, so that the heat generated by the heating means is radiated directly into the spatial region to be heated. These materials also have almost no heat expansion, so that deformations of the heating element do not occur. The covering glass, glass-ceramic or ceramic plate can be cleaned of contaminants in a simple way with conventional cooktop cleaners. In the case of stubborn contaminants, a common scraper for glass-ceramic cooktops can also be used.

In this case, the heating means can be designed as a heating foil or film or as flat heating unit. Alternatively, the heating means can also be designed as a heat-conducting coating or printed heat conductor introduced on the side of the plate turned away from the spatial region to be heated.

If only one of the spatial regions is to be heated, according to one embodiment of the invention, the heating means can be provided with a layer of thermal insulation on the side turned away from the spatial region to be heated. The layer of thermal insulation largely prevents the heat from radiating into the spatial region that is not to be heated. Rather, nearly the entire radiant heat produced by the heating means is delivered to the spatial region that is to be heated.

According to a further-reaching concept, the layer of thermal insulation can be covered with a metal plate on the side turned away from the spatial region to be heated. The metal plate protects the insulation layer from damage.

According to another basic concept of the invention, the heating means can be covered on both sides with a plate comprising a selection of glass, glass ceramics and ceramics. This arrangement makes it possible for the spatial regions disposed on both sides of the heating element to be able to be heated with a single heating means.

According to yet another basic concept of the invention, the heating element can have a first heating means and a second heating means, which are separated from one another by a layer of thermal insulation disposed between them. In this case, the first heating means is covered on the side facing the first spatial region to be heated with a first plate comprising a selection of glass, glass ceramics and ceramics, and the second heating means is covered on the side facing the second spatial region to be heated with a second plate comprising a selection of glass, glass ceramics and ceramics.

This arrangement makes it possible to heat the spatial regions disposed on both sides of the heating element independently of one another. A corresponding contacting or interconnecting of the two heating means with the control device of the baking oven or the external electronic mechanism makes possible a separate control of the two heating means.

In order to hold the layer and plate arrangement of the heating element together in a combined unit and in order to avoid damage to the edge regions, a surrounding metal frame formed as a U profile can be disposed on the layer and plate arrangement, this frame gripping the layer and plate arrangement at least at the edge region from the side facing the first spatial region to the side facing the second spatial region. With this arrangement, the individual layers and plates of the heating element are securely held together. In addition, the individual layers and plates or parts of the layers and plates can be glued together. For this purpose, temperature-resistant adhesives relative to the temperature region of interest here are known.

According to a further-reaching concept of the invention, the metal frame can be designed in one piece with the metal plate covering the layer of thermal insulation or can be solidly joined with it. Such an arrangement particularly offers high stability and an effective protection against penetrating contaminants.

In order to assure a desired orientation of the heating element in the baking space, the contacting means may have an arrangement of plug contacts, which has a coding defined by the distribution, size and shape of the plug contacts and corresponding to the orientation of the heating element in the baking space and on the external electronic mechanism. With this arrangement of plug contacts, it is assured that the heating element can be connected only in a predetermined orientation to the power supply and control device of the baking and roasting oven and to the power supply and control device of the external electronic mechanism.

In the arrangement of the heating element according to the invention with the electronic mechanism external to the baking and roasting oven, it is provided that the external electronic mechanism has a retaining element for receiving the heating element, the retaining element being provided with its own power supply and control device. With this, it is assured that the heating element can also be operated outside the baking space of the baking and roasting oven.

For this purpose, the heating element can be removed from the baking space in a simple way, whereby the electrical contact to the power supply and control device of the baking and roasting oven is disconnected. Subsequently, the heating element can then be inserted into the retaining element of the external electronic mechanism, whereby the heating element is then connected to the power supply and control device of the external electronic mechanism.

According to a preferred embodiment, the retaining element can have a U-shaped uptake profile for receiving an edge region of the heating means and a plug receptacle for contacting the contacting means of the heating means to the power supply and control device of the external electronic mechanism. This arrangement makes it possible to securely hold the heating element preferably in horizontal or vertical position, and creates a simple way of connecting to the power supply and control device of the external electronic mechanism.

The invention will be explained in more detail below based on the exemplary embodiments shown in the drawings.

Herein:

FIG. 1*a* shows in a very simplified, schematic front view a baking space of a conventional baking and roasting oven;

FIG. 1*b* shows in a very simplified, schematic front view a baking space of a baking and roasting oven divided into two spatial regions of equal size by a heating element used as a baking-space divider;

FIG. 1*c* shows in a very simplified, schematic front view a baking space of a baking and roasting oven divided into two spatial regions of different size by a heating element used as a baking-space divider;

FIG. 1*d* shows in a very simplified, schematic front view a baking space of a baking and roasting oven divided into three spatial regions of equal size by two heating elements used as baking-space dividers;

Figure 4A:
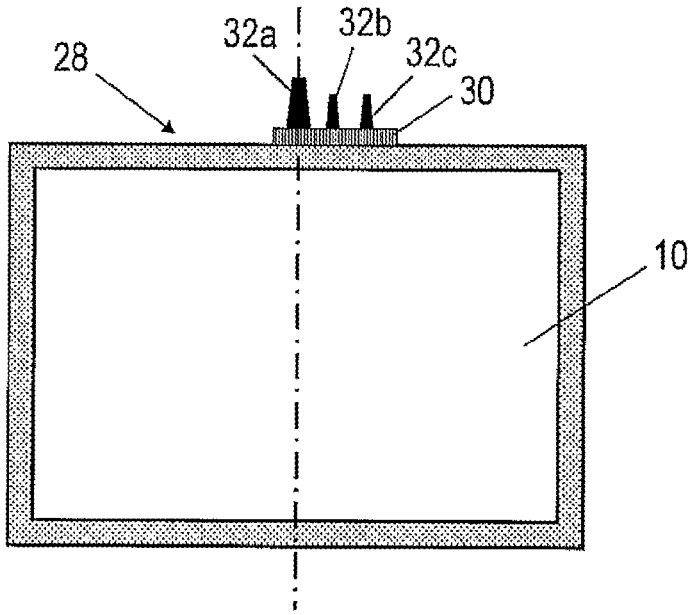
Figure 4B:
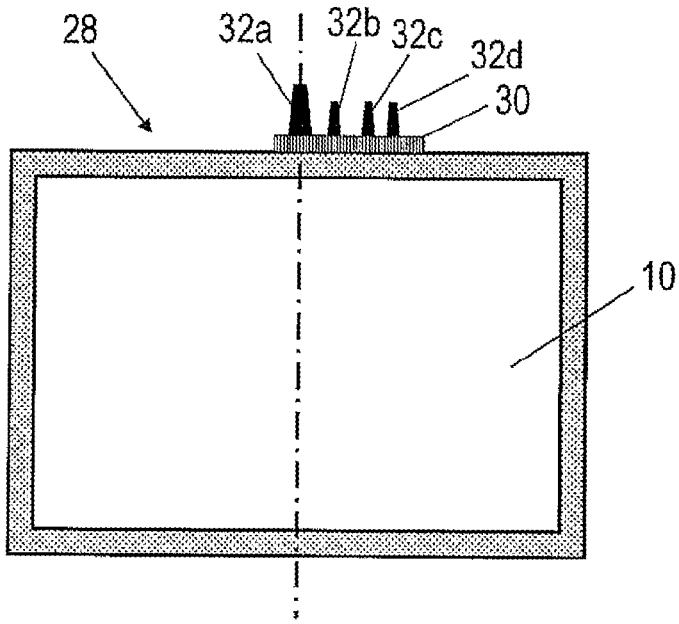
Figure 5:
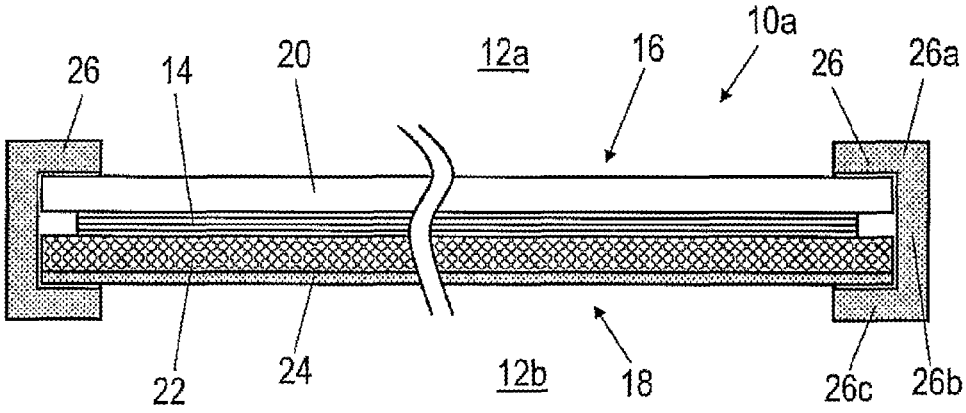
Figure 6:
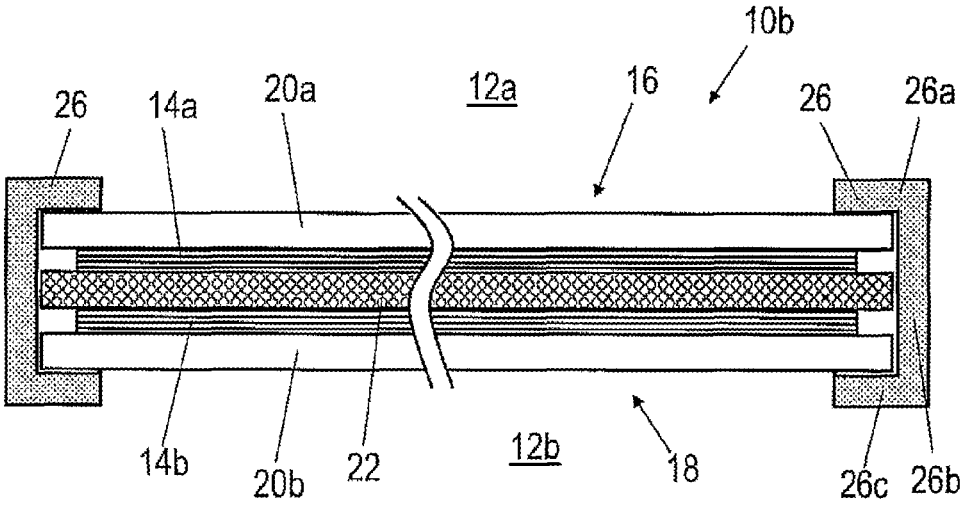
Figure 7:
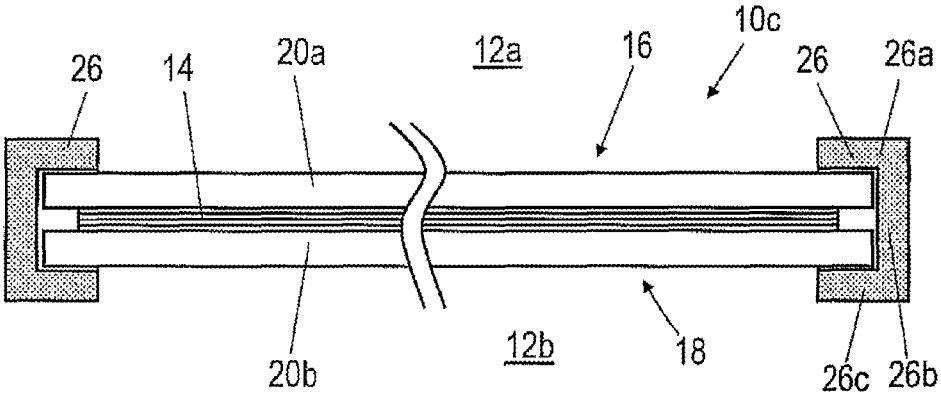
Figure 8:
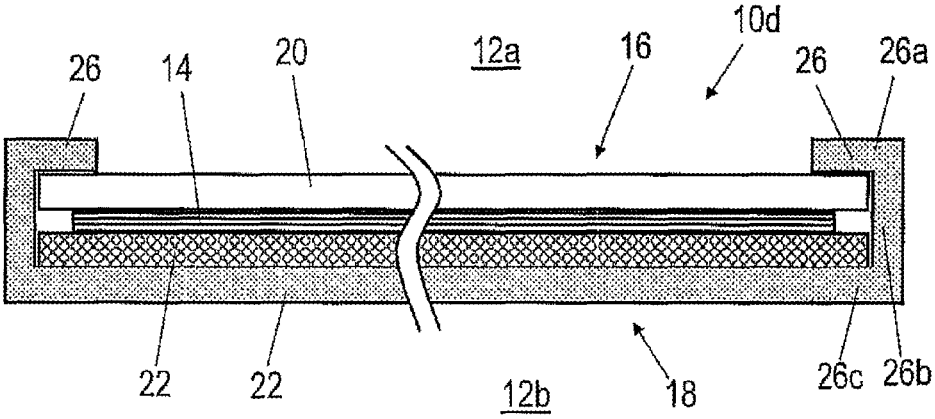
Figure 9A:
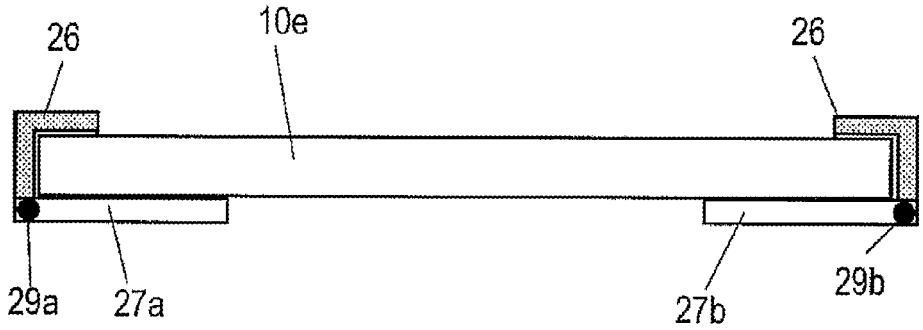
Figure 9B:
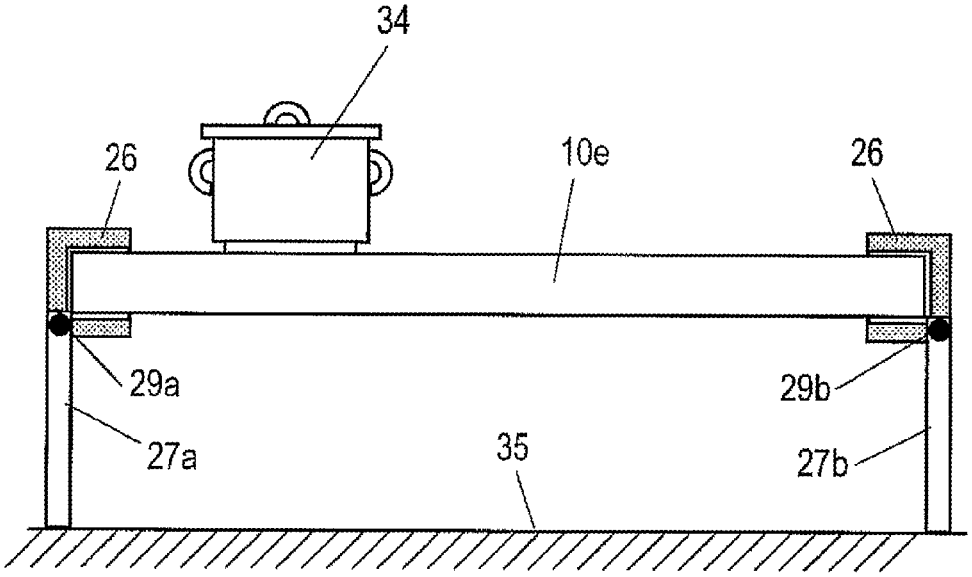
Figure 10:
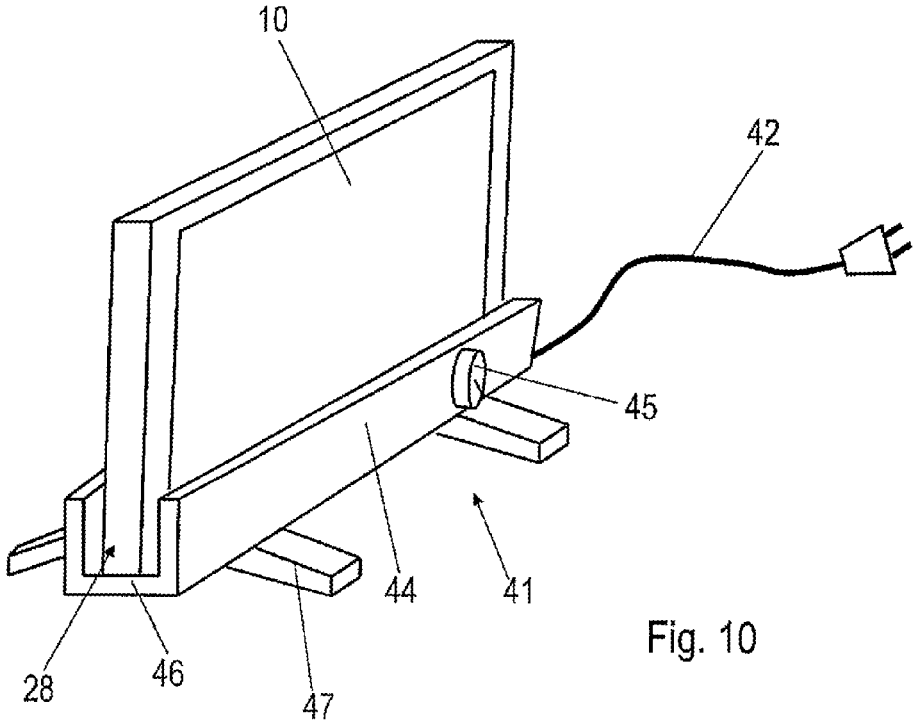

FIG. 4*a* shows in a schematic top view a heating element with a contacting means according to another embodiment;

FIG. 4*b* shows in a schematic top view a heating element with a contacting means according to yet another embodiment of the invention;

FIG. 5 shows in a schematic lateral view and in section an embodiment of a heating element according to the invention for heating a spatial region;

FIG. 6 shows in a schematic lateral view and in section another embodiment of a heating element according to the invention for the separate heating of two spatial regions;

FIG. 7 shows in a schematic lateral view and in section yet another embodiment of a heating element according to the invention for the joint heating of two spatial regions;

FIG. 8 shows in a schematic lateral view and in section another embodiment of a heating element according to the invention with a partial metal jacket;

FIG. 9*a* shows in a schematic lateral view and in section yet another embodiment of a heating element according to the invention with a support foot means that can be folded out, in the folded-in position;

FIG. 9*b* shows in a schematic lateral view and in section the heating element shown in FIG. 9*a* with a support foot means that is folded out;

FIG. 10 shows in a schematic and perspective view a heating element according to the invention, which is taken up in a retaining element of an external electronic mechanism in vertical position.

Figure 11:
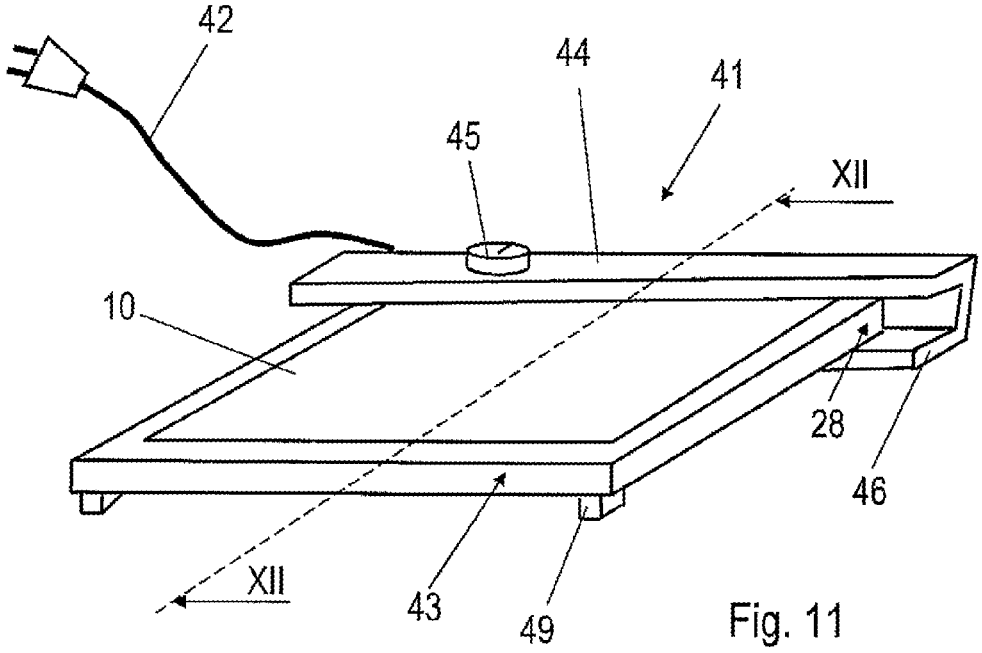
Figure 12:
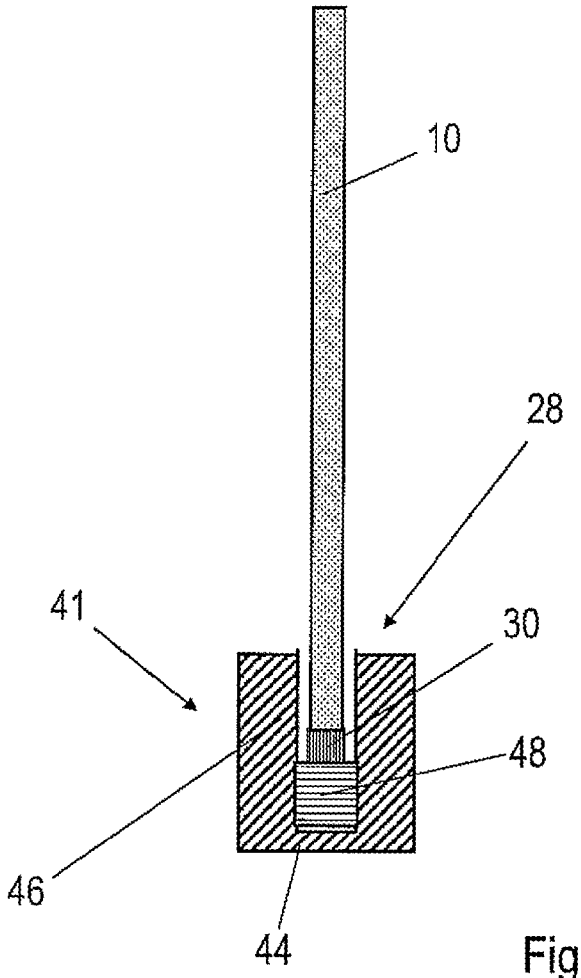

FIG. 11 shows in a schematic and perspective view the heating element according to the invention taken up in the retaining element of the external electronic mechanism according to FIG. 10 in a horizontal position; and FIG. 12 shows in a greatly simplified, schematic lateral view and in section along cutting line XII-XII in FIG. 11 the heating element according to FIGS. 10 and 11, whereby the contacting means of the heating means is connected to the power supply and control device of the electronic mechanism via the plug receptacle thereof.

Figure 1A:
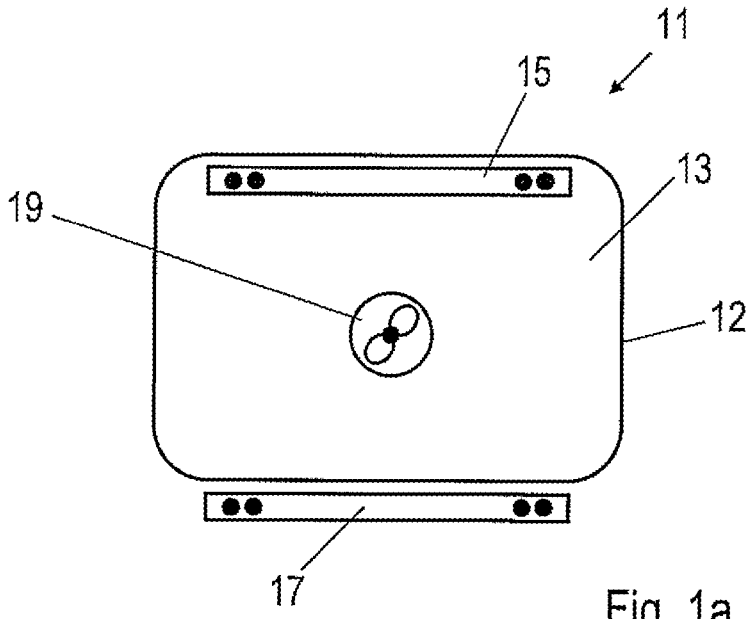

FIG. 1*a* shows in a very simplified, schematic front view a baking space 12 of a conventional baking and roasting oven 11. The baking space serves for baking, roasting and cooking foods. The baking space 12 can be closed on the front side by a door (not shown). A top heating and grilling unit 15 is disposed at the top of the baking space. A bottom heating unit 17 is disposed at the bottom of baking space 12. A heat circulating fan 19 is disposed centrally on the back wall 13 of the baking space 12 for distributing the hot air. The baking space 12 is formed of a stainless steel or enamel oven cavity, which can be heated in different ways with top heating, grilling function, bottom heating, and hot air depending on the desired cooking method. The different ways of heating are activated via a programming switch and a temperature regulator (not shown) on baking and roasting oven 11. The complete baking space is heated independently of the quantity and size of the food to be cooked.

Figure 1B:
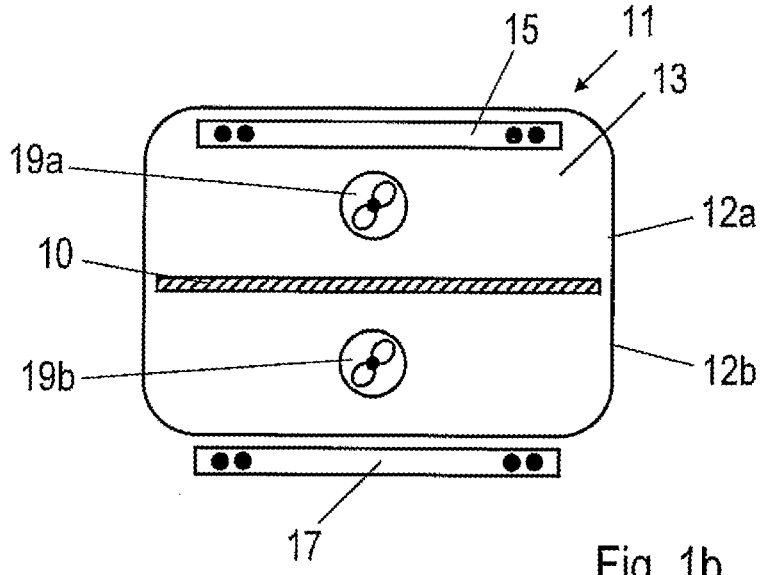

FIG. 1*b* shows in a very simplified, schematic front view a baking space 12 of a baking and roasting oven 11 divided into two spatial regions 12*a* and 12*b* of equal size by a heating element 10 used as a baking-space divider. In this case, heating element 10 is inserted into the baking space 12 on centrally disposed guide rails. The top spatial region 12*a* is heated on top by the top heating and grilling unit 15 and on the bottom by the heating element 12. A heat circulating fan 19*a* is disposed in the upper spatial region 12*a* on the back wall 13 of the baking space 12. The bottom spatial region 12*b* is heated on top by the heating element 10 and on the bottom by the bottom heating unit 17. A heat circulating fan 19*b* is disposed on the back wall 13 of the baking space 12 in the lower spatial region 12*b*. Depending on the design of the heating element 10 in each case, the upper spatial region 12*a* and/or the lower spatial region 12*b* is heated separately or jointly. The heating element 10 can be removed from the baking space 12, if necessary, in order to make available the complete volume of the baking space 12. The heat circulating fans 19*a* and 19*b* disposed on the back wall 13 of the baking space 12 can also be replaced by other heat circulating arrangements in an alternative embodiment (not shown).

Figure 1C:
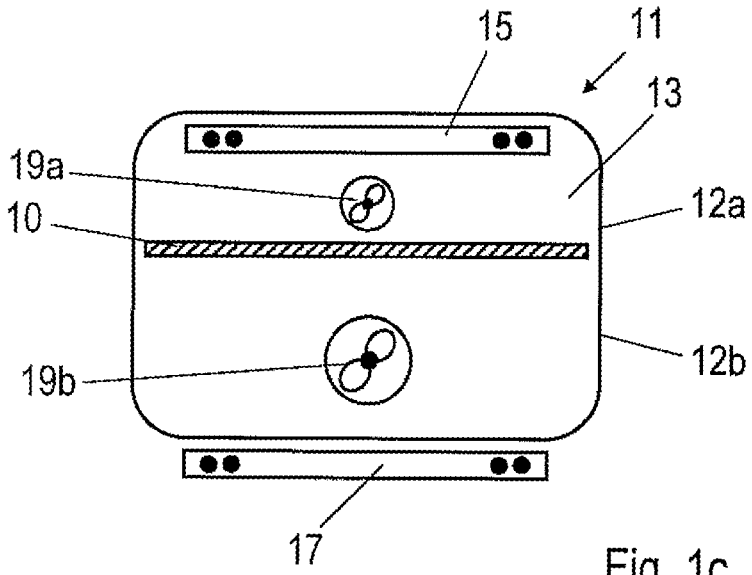

FIG. 1*c* shows in a very simplified, schematic front view a baking space 12 of a baking and roasting oven 11 divided into two spatial regions 12*a* and 12*b* of different size by a heating element 10 used as a baking-space divider. The upper spatial region 12*a* is smaller than the lower spatial region 12*b*. As is clear based on FIGS. 1*b* and 1*c*, the heating element 10 can be inserted into the baking space in different positions for the divider, depending on the arrangement of the guide rails in baking space 12 in each case.

Figure 1D:
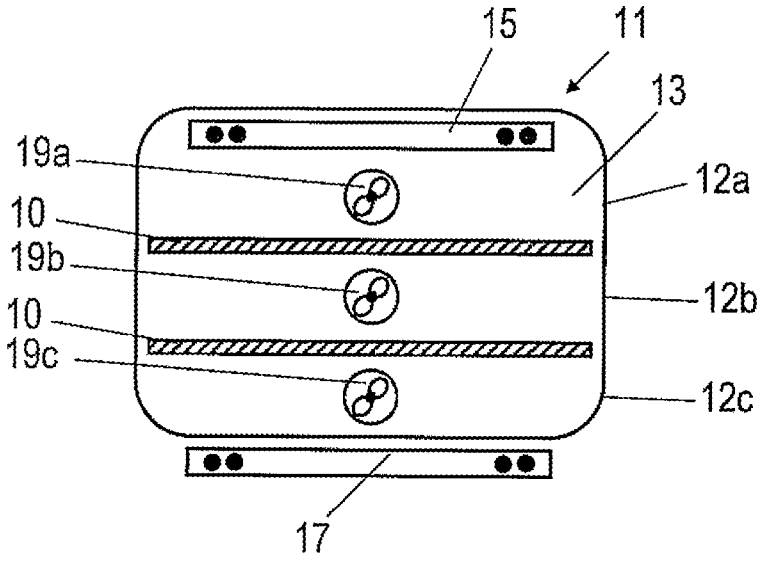

FIG. 1*d* shows in a very simplified, schematized front view a baking space of a baking and roasting oven 11 divided into three spatial regions of equal size 12*a*, 12*b* and 12*c* by two heating elements 10 used as baking-space dividers. A heat circulating fan 19*a*, 19*b* or 19*c* is disposed on the back wall 13 of the baking space 12 in each of the three spatial regions 12*a*, 12*b* and 12*c*.

Figure 2:
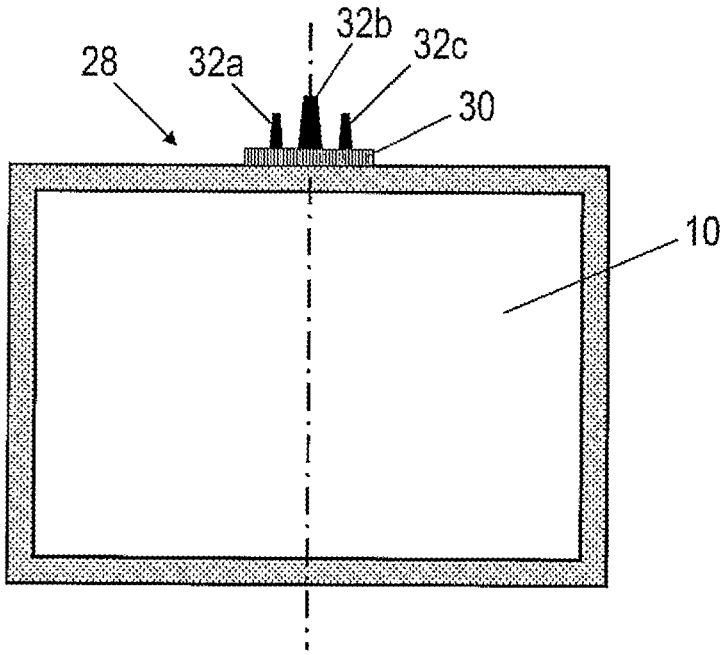
FIG. 2 shows in a schematic top view a heating element according to the invention with a contacting means disposed in the back edge region.

FIG. 2 shows in schematic top view a heating element 10 with a plate-shaped configuration that is rectangular in top view. A contacting means 30 for electrically connecting the baking-space component 10 to the power supply and control device (not shown) of the baking and roasting oven 11 is disposed on the heating element 10 at the back edge region 28, which is facing the back wall 13 of the baking space 12. The contacting means 30 is also designed for connecting to an external electronic mechanism described in more detail on the basis of FIGS. 10 and 11.

The heating means, which is found in heating element 10 and which is described in more detail on the basis of FIGS. 5 to 8 below, is solidly electrically connected to the contacting means 30 and is connected to the power supply and control device of baking oven 11 when the heating element 10 is inserted into the baking space 12. In this way, the control device of the baking oven 11 recognizes that the heating element 10 is inserted into the baking space 12 and in which position it is inserted. The baking oven control then automatically activates the program controls provided for the divided spatial regions, so that two baking spaces that can be used separately are made available for the user. The position of the heating element as well as its power supply are recognized via the plug contacts 32*a*, 32*b* and 32*c* disposed on contacting means 30.

Figure 3:
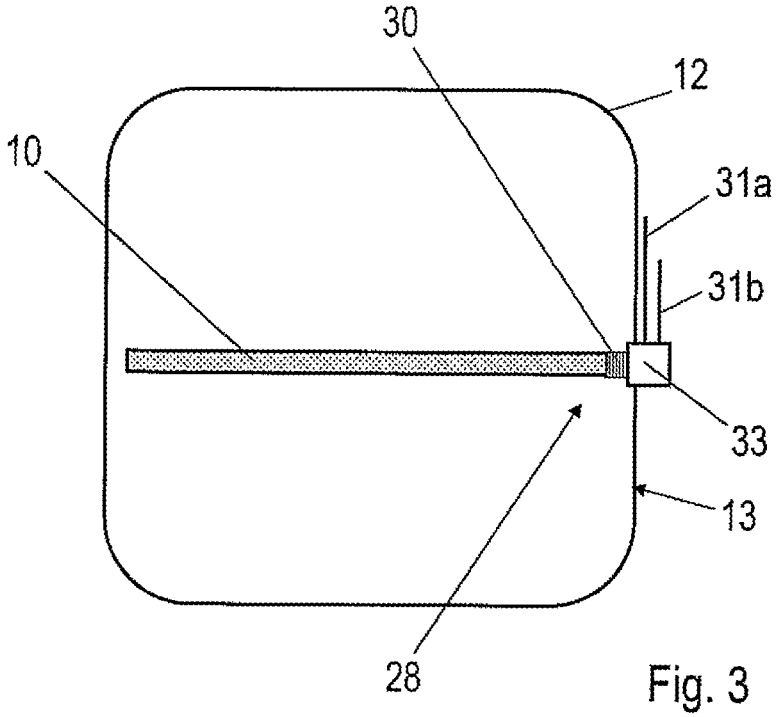
FIG. 3 shows in a very simplified, schematic lateral view the baking space of a baking and roasting oven with an inserted heating element used as a baking-space divider according to FIG. 2, the heating means being connected to the power supply and control device of the baking and roasting oven.

FIG. 3 shows in a very simplified, schematic lateral view the baking space 12 of a baking and roasting oven 11 with an inserted heating element 10 according to FIG. 2, the heating means being connected to the power supply and control device of the baking and roasting oven 11. The contacting means 30 is disposed at the edge region 28 of the heating element 10 facing the inner back wall 13 of the baking space 12. The plug contacts 32*a*, 32*b* and 32*c* shown in FIG. 2 project in the direction onto the back wall 13 from the contacting means 30. When the heating element 10 is inserted, the plug contacts 32*a*, 32*b* and 32*c* are taken up in a corresponding plug receptacle 33 on the back wall 13 of the baking space 12. Electrical leads 31*a* and 31*b* lead from the plug receptacle 33 to the power supply and control device of baking oven 11.

By symmetric or asymmetric arrangement of the plug contacts 32*a*, 32*b* and 32*c* on the contacting means 30, the position at which the heating element is inserted can be recognized, when this will lead to different heating functions. According to FIG. 2, the three plug contacts 32*a*, 32*b* and 32*c* are symmetrically disposed relative to the central axis of the heating element. In this case, the central, longest plug contact 32*b* is disposed on the center perpendicular line of the heating element 10. The two smaller plug contacts 32*a* and 32*c* are disposed symmetrically relative to the central plug contact 32*b*.

FIG. 4*a* shows in a schematic top view a heating element 10 with a contacting means 30 according to another embodiment. As FIG. 4*a* shows, the longest plug contact 32*a* is disposed on the center perpendicular line of the heating element 10, and the plug contacts 32*b* and 32*c* are disposed to the right thereof at equal distances to one another. A coding results due to the distribution, size and shape of plug contacts 32*a*, 32*b* and 32*c*.

FIG. 4*b* shows in a schematic top view a heating element 10 with a contacting means 30 according to yet another embodiment of the invention. As FIG. 4*b* shows, three additional, shorter plug contacts 32*b* and 32*c* and 32*d* to the right of the longest plug contact 32*a* are disposed at different distances to one another. A coding results from this that is different from that of the contacting means 30 shown in FIG. 4*a*.

Based on FIGS. 6 to 8, and 9*a* and 9*b*, different embodiments of the heating element 10, and 10*a* to 10*g*, according to the invention are described below, all of which can be applied and/or equipped according to the embodiments described on the basis of FIGS. 1*b* to 1*d*, and 2, 3, 4*a* and 4*b*, or can additionally have the features described therein.

FIG. 5 shows in a schematic lateral view and in section an embodiment of a heating element 10*a* according to the invention for heating only a spatial region 12*a*. The heating element 10*a* has a flat electrical heating means 14, which is covered with glass ceramics 20 on the side 16 facing the spatial region 12*a* to be heated. Alternatively, heating means 14 can also be covered by a glass plate or a ceramic plate. A layer of thermal insulation 22 is disposed underneath the heating means 14. The thermal insulation layer 22 provides for delivering heating power only in the direction of the upper spatial region 12*a*. In turn, a metal plate 24 is disposed underneath thermal insulation layer 22 on the side 18 turned away from the spatial region 12*a* to be heated or on the side 18 facing the spatial region 12*b* that is not to be heated.

The heating means 14 shown in FIG. 5 is formed as a heating foil. This type of heating foil is offered, for example, under the name Thermofoil of the Mika company. These foils can be adapted to different embodiments of heating elements, depending on the required amount of heat and specific heating power. Such a heating foil can also be composed of several heating circuits that can be differently controlled in order to make possible different heating profiles in a targeted manner.

According to one embodiment (not shown), the heating means 14 can also be designed as a flat heating unit. Such flat heating units are offered, for example, by the Eichenauer company.

According to yet another embodiment (not shown), the heating means 14 can also be designed as a heat conductor coating or printing on the side of the glass-ceramic plate 20 turned away from the spatial region 12*a* to be heated.

The heating means 14 is provided with a contacting means 30 shown according to FIGS. 2, 4*a* or 4*b* and can be connected electrically by this means to the power supply and control device of the baking oven 11 and to the power supply and control device of an external electronic mechanism 41. The contacting means 30 is not shown in FIG. 5, however.

A surrounding metal frame 26 is disposed on the layer arrangement of heating element 10*a* composed of the glass-ceramic plate 20, the heating means 14, the layer of thermal insulation 22 and the metal plate 24, this arrangement being rectangular in top view (see, for example, FIG. 2). The metal frame has a U-shaped cross-sectional profile and grips the heating element 10*a* at least at the edge region from the side facing the first spatial region 12*a* to the side facing the second spatial region 12*b*. Thus, the U profile of the metal frame 26 has an upper frame part 26*a* that runs parallel to the glass-ceramic plate 20 disposed on the top, this upper frame part lying next to this plate and forming a leg of the U profile. In addition, frame 26 has a lower frame part 26*c* that runs parallel to metal plate 24 disposed on the bottom, this lower frame part lying next to this plate, extending parallel to the upper frame part 26*a* and forming the second leg of the U profile. The two frame segments 26*a* and 26*c* are joined together by a connecting part 26*b* extending perpendicular thereto.

FIG. 6 shows in a schematic lateral view and in section another embodiment of a heating element 10*b* according to the invention for the separate heating of two spatial regions 12*a* and 12*b*. The heating element 10*b* has a first heating means 14*a* and a second heating means 14*b*. The first heating means 14*a* is separated from the second heating means 14*b* by a layer of thermal insulation 22 disposed therebetween. The first heating means 14*a* is covered with a first glass-ceramic plate 20*a* on the side facing the first spatial region 12*a* to be heated. The second heating means 14*b* is covered with a second glass-ceramic plate 20*b* on the side facing the second spatial region 12*b* to be heated. Alternatively, the two heating means 14*a* and 14*b* can also be covered by a glass plate or a ceramic plate.

The two heating means 14*a* and 14*b* are formed as heating foils. Alternatively, the two heating means 14*a* and 14*b* can also be designed as flat heating units or as direct heat-conductor coatings or printings. The first heating means 14*a* and the second heating means 14*b* are provided with a contacting means 30 shown according to FIGS. 2, 4*a* or 4*b* and can be electrically connected therewith to the power supply and control device of baking oven 11 and to the power supply and control device of an external electronic mechanism 41. The contacting means 30 is not shown in FIG. 6, however.

A surrounding metal frame 26 is disposed on the layer arrangement of the heating element 10*b* composed of the upper glass-ceramic plate 20*a*, the upper heating means 14*a*, the layer of thermal insulation 22, the lower heating means 14*b* and the lower glass-ceramic plate 20*b*, this arrangement being rectangular in top view (see, for example, FIG. 2), as it was already described on the basis of FIG. 5.

FIG. 7 shows in schematic lateral view and in section yet another embodiment of a heating element 10*c* according to the invention for the combined heating of two spatial regions 12*a* and 12*b*. The heating element 10*c* has a flat electrical heating means 14, which is designed as a heating foil. Alternatively, the heating means 14 can also be designed as a flat heating unit or as a direct heat-conductor coating or printing. The heating means 14 is covered with a first glass-ceramic plate 20*a* on the side facing the first spatial region 12*a* to be heated. The heating means 14 is covered with a second glass-ceramic plate 20*b* on the side facing the second spatial region 12*b* to be heated. Alternatively, the heating means 14 can also be covered by glass plates and/or ceramic plates.

A surrounding metal frame 26 is disposed on the layer arrangement of the heating element 10*c* composed of the heating means 14 and the glass-ceramic plates 20*a* and 20*b* disposed on both sides thereon, this arrangement being rectangular in top view (see, for example, FIG. 2), as it was already described on the basis of FIG. 5.

FIG. 8 shows in a schematic lateral view and in section another embodiment of a heating element 10*d* according to the invention, having a partial metal jacket. The heating element 10*d* is constructed similarly to the heating element 10*a* shown in FIG. 5. A heating means 14 is covered on top by a glass-ceramic plate 20. A layer of thermal insulation 22 is attached on the underside on heating means 14. On the side 18 turned away from the spatial region 12*a* to be heated, the thermal insulation layer 22 is covered with a metal plate 24, which is formed in one piece with the metal frame 26. Together with the metal frame 26, the metal plate 24 forms a partial jacket for the layer arrangement, which is rectangular in top view (see, for example, FIG. 2), of the heating element 10*d*, which is composed of the glass-ceramic plate 20, the heating means 14 and the thermal insulation layer 22.

FIG. 9*a* shows in schematic lateral view and in section yet another embodiment of a heating element 10*e* according to the invention. The heating element 10*e* can be designed corresponding to the embodiments shown in FIGS. 5 to 8. In order to install the heating element 10 on an installation surface outside the baking space, a support foot means that can be folded out is disposed on the metal frame 26. The support foot means has four support feet, only two of which are shown in FIG. 9*a*, and these are provided with reference numbers 27*a* and 27*b*. The support feet are disposed at the corner regions of the heating element 10*e* which is rectangular in top view (see, for example, FIG. 2). The support feet 27*a* and 27*b* are each connected to the metal frame 26 by means of a hinge joint 29*a* or 29*b*. In the folded-in state, support feet 27*a* and 27*b* lie parallel to the metal frame 26.

Instead of four individual support feet 27*a*, 27*b*, two arc-shaped feet, which are hinged to fold out on both sides, can also find use.

FIG. 9*b* shows in a schematic lateral view and in section the heating element 10*e* which is shown in FIG. 9*a* and which has a support foot means that is folded out. In this case, support feet 27*a* and 27*b* are folded out perpendicular to the folded-in position shown in FIG. 9*a*, via hinge joints 29*a* and 29*b*. The heating element 10*e* is disposed on an installation surface 35 outside the baking space.

The support foot means may additionally have a catch means (not shown), with the help of which the support feet 27*a* and 27*b* are held in the folded-out position. A pot 34 to keep hot is placed on the heating element 10*e* serving as a warming plate.

The heating means shown in FIGS. 9*a* and 9*b* also has the contacting means 30 described in more detail on the basis of FIGS. 2, 3, 4*a* and 4*b* and can be electrically connected therewith not only to the power supply and control device of the baking oven 11, but also to the power supply and control device of an external electronic mechanism 41 (shown in FIGS. 10 to 12). In addition to the utilization of the stored heat, it is thus also possible to provide an active heating operation via the power supply and control device of the external electronic mechanism 41.

FIG. 10 shows in a schematic and perspective view a heating element 10 according to the invention, which is taken up in a retaining element 44 of an external electronic mechanism 41 in vertical position. The retaining element 44 has a U-shaped uptake profile 46 that is open toward the top for receiving the edge region 28 of the heating element 10. Four support feet 47 are introduced on the retaining element 44. In the inserted state, the heating element 10 can be secured against falling out or accidentally being pulled out, with clips, snaps or similar locking devices as needed.

A power supply and control device (not shown) is integrated in the external electronic mechanism 41. The device can be connected to a common power outlet via a power cable 42. The heating means 14 of the heating element 10 is connected to the power supply and control device of the electronic mechanism 41 in the state when inserted in the retaining element 44. A rotary switch 45 that interacts with the power supply and control device is introduced on electronic mechanism 41. The desired temperature of the heating element 10 can be adjusted by the rotary switch 45. Regulation can likewise be carried out via another known switch design, for example, via a sliding control, a push button or a touch switch. Operation via a remote control is also conceivable.

FIG. 11 shows in a schematic and perspective view the heating element 10 according to the invention, which is taken up in a horizontal position in the retaining element of the external electronic mechanism according to FIG. 10. The retaining element 44 of the external electronic mechanism 41 is tipped compared to the position shown in FIG. 10, so that the U-shaped uptake profile 46 is aligned open to the front for the horizontal uptake of the edge region 28 of the heating element 10.

The support feet 47 shown in FIG. 10 are not present in the position shown in FIG. 11. The support feet 47 can be removed from the retaining element 44 or designed so that they can fold in on it.

On the edge region 43, which is in front in the view of FIG. 11 and which is turned away from the edge region 28 taken up in the U-shaped uptake profile 46, support feet 49 are arranged, which support the horizontal heating element 10 against the installation surface.

FIG. 12 shows in a greatly simplified, schematic lateral view and in section along cutting line XII-XII in FIG. 11 the heating element 10 according to FIG. 11, the contacting means 30 of the heating means 14 being connected to the power supply and control device of the electronic device 41 via the plug receptacle 48 thereof.

As has already been explained based on FIG. 3, when the heating element 10 is used as a baking-space divider in the baking space 12 of a baking and roasting oven 11, the edge region 28 faces the inner back wall 13 of the baking space 12. The contacting means 30 is disposed at the edge region 28 of the heating element 10. The plug contacts 32*a*, 32*b* and 32*c* shown in FIG. 2 project from the contacting means 30 in the direction onto the back wall 13 of the baking space 12. When the heating element 10 is inserted, the plug contacts 32*a*, 32*b* and 32*c* are taken up in the corresponding plug receptacle 33 on the back wall 13 of the baking space 12. Electrical leads 31*a* and 31*b* lead from the plug receptacle 33 to the power supply and control device of the baking oven 11.

In the state when they are taken up in the U-shaped uptake profile 46 of the retaining element 44, the projecting plug contacts 32*a*, 32*b* and 32*c* shown in FIG. 2 are introduced into a corresponding plug receptacle 48 disposed inside the U-shaped uptake profile 46. The plug receptacle 48 is connected to the power supply and control device of the external electronic mechanism 41 by electrical leads (not shown).

Based on the arrangement of the plug contacts 32*a*, 32*b* and 32*c* on the contacting means 30, and based on the distribution, size and shape of the plug contacts, it is assured that the heating element 10 is taken up in the correct position and orientation in the U-shaped uptake profile 46 of the retaining element 44.

The invention claimed is:

1. A heating element, comprising:

at least one flat electrical heating device configured to heat at least a first side of the heating device; and a contacting device configured to connect the heating device to a power supply and control device of a baking and roasting oven or to an electronic mechanism external to the baking and roasting oven, wherein the heating device is configured to form a baking-space divider for inserting into the baking space of the baking and roasting oven and for dividing the baking space into two spatial regions when connected to the power supply and control device of the baking and roasting oven, and wherein the heating device is configured to form a warmer for spaces outside of the baking space when connected to the electronic mechanism external to the baking and roasting oven.

2. The heating element according to claim 1, wherein the first side is covered by a plate comprising a material selected from the group consisting of glass, glass ceramics, and ceramics.

3. The heating element according to claim 1, wherein the heating device comprises a thermal insulation layer on a second side, the second side being turned away from the spatial region to be heated.

4. The heating element according to claim 3, wherein the thermal insulation layer is covered with a metal plate.

5. The heating element according to claim 1, wherein the heating device is covered on both the first side and a second, opposite side with a plate.

6. The heating element according to claim 1, wherein the heating device comprises a first heating device and a second heating device that are disposed separately from one another by a layer of thermal insulation disposed therebetween, the first heating device being covered on a first side with a first plate comprising a material selected from the group consisting of glass, glass ceramics, and ceramics, and the second heating device being covered on a second side with a second plate comprising a material selected from the group consisting of glass, glass ceramics, and ceramics.

7. The heating element according to claim 5, further comprising a surrounding metal frame which is shaped as a U profile, the metal frame gripping the heating device and plates at least at an edge region.

8. The heating element according to claim 7, wherein the metal frame is formed in one piece.

9. The heating element according to claim 7, wherein the contacting device is disposed at the edge region of the heating element.

10. The heating element according to claim 9, wherein the contacting device has an arrangement of plug contacts, which has a coding defined by the distribution, size and shape of the plug contacts, corresponding to an orientation of the heating element in the baking space of the baking and roasting oven and on the external electronic mechanism.

11. The heating element according to claim 1, wherein the warmer is selected from the group consisting of a warming plate for food, a heating device for a residential room, and a terrace heater.

12. An arrangement for a baking and roasting oven, comprising:

an electronic mechanism external to the baking and roasting oven; and a heating element having at least one flat electrical heating device configured to heat at least one spatial region on a first side of the heating device and a contacting device configured to connect the heating device to a power supply and control device of the baking and roasting oven or to the electronic mechanism, wherein the external electronic mechanism has a retaining element for the heating device, the retaining element being provided with a power supply and control device.

13. The arrangement according to claim 12, wherein the retaining element has a U-shaped profile for gripping an edge region of the heating device and a plug receptacle for contacting the contacting device with the power supply and control device of the external electronic mechanism.

* * * * *